US007899398B2

(12) United States Patent
Lee

(10) Patent No.: US 7,899,398 B2
(45) Date of Patent: Mar. 1, 2011

(54) PORTABLE KARAOKE SYSTEM

(75) Inventor: Kyung Ho Lee, Seoul (KR)

(73) Assignees: Enter Tech Co., Ltd (KR); Kyung-Ho Lee (KR)

( * ) Notice: Subject to any disclaimer, the term of this patent is extended or adjusted under 35 U.S.C. 154(b) by 1064 days.

(21) Appl. No.: 10/569,296

(22) PCT Filed: May 19, 2004

(86) PCT No.: PCT/KR2004/001188

§ 371 (c)(1),
(2), (4) Date: Feb. 23, 2006

(87) PCT Pub. No.: WO2004/105037

PCT Pub. Date: Dec. 2, 2004

(65) Prior Publication Data

US 2006/0251262 A1 Nov. 9, 2006

(30) Foreign Application Priority Data

May 20, 2003 (KR) ..... 20-2003-0015537 U
May 20, 2003 (KR) ..... 20-2003-0015539 U
May 15, 2004 (KR) ..... 20-2004-0013536 U

(51) Int. Cl.
*H04H 20/48* (2008.01)

(52) U.S. Cl. ..... 455/41.3; 455/418; 455/550.1; 455/556.1; 370/328; 381/2; 84/610

(58) Field of Classification Search ..... 370/328; 84/610; 455/41.3, 418, 550.1, 556.1; 381/2
See application file for complete search history.

(56) References Cited

U.S. PATENT DOCUMENTS 4,344,184 A * 8/1982 Edwards ..... 455/95
5,808,224 A * 9/1998 Kato ..... 84/609
6,025,553 A * 2/2000 Lee ..... 84/610
6,027,380 A * 2/2000 Hanning et al. ..... 439/716
6,267,600 B1 * 7/2001 Song ..... 434/307 A
6,294,286 B1 * 9/2001 Gosior et al. ..... 429/96
6,530,804 B1 * 3/2003 Wu ..... 439/500
2003/0026595 A1 * 2/2003 Ikeda ..... 386/96
2004/0204028 A1 * 10/2004 Kotzin ..... 455/551

* cited by examiner

*Primary Examiner*—Charles N Appiah
*Assistant Examiner*—William F Rideout
(74) *Attorney, Agent, or Firm*—The Farrell Law Firm, P.C.

(57) ABSTRACT

The present invention discloses a portable Karaoke system. The portable Karaoke system has a separate radio auxiliary microphone receiving module and a separate FM transmission module, which can be inserted/separated into/from the portable Karaoke system, such that a user can select and purchase only a required function module and easily carry and keep the portable Karaoke system. The portable system has hooks, which are provided at both sides of a battery case to prevent a battery from being easily separated from the battery case, and semicircular recesses, which are formed at the top edges of both sidewalls of the battery case to allow a user to easily remove the battery from the battery case. Furthermore, the portable Karaoke system has first and second gears formed at stepped portions of the end of a microphone body such that the first gear is combined with a general microphone and the second gear is combined with a ball-type microphone net.

5 Claims, 10 Drawing Sheets

PORTABLE KARAOKE SYSTEM

TECHNICAL FIELD

The present invention relates to a portable Karaoke system, and more particularly, to a portable Karaoke system that has a separate radio auxiliary microphone receiving module and a separate FM transmission module, which can be inserted/separated into/from the portable Karaoke system, and a battery case structure for preventing a battery set in a battery case from being easily separated therefrom due to an external shock and allowing a user to easily remove the battery from the battery case, and allows the user to selectively combine a general microphone net and a ball-type microphone net with the Karaoke system such that the user can easily carry and keep the portable Karaoke system.

BACKGROUND ART

A conventional portable Karaoke system includes a microphone for converting a user's voice into an electric signal to output it through a speaker, a key unit through which a user selects a song, a display for displaying the operation state of the portable Karaoke system, and a control circuit for storing accompaniment data with respect to songs and video signals corresponding to background images and processing the stored signals. The microphone is placed on the top of a case of the portable Karaoke system, and the key unit and the display are attached to one side of the case. The control circuit is constructed on a board that is set inside the case.

The conventional portable Karaoke system radio-transmits the accompaniment sound, lyrics and background image of a song the user selects through the key unit to an image display device such as TV to display the lyrics and background image on a screen of the image display device and to output the accompaniment sound through a speaker included in the image display device. The accompaniment sound can be output through a home audio system or a car audio system and the user can sing to the accompaniment sound, holding the main body of the portable Karaoke system by the hand.

In the conventional portable Karaoke system, however, all of a circuit for radio-receiving video and audio signals, the control circuit and a transmission circuit are constructed on the board set in the case of the system. This increases the size of the board and thus the user has a difficulty in holding the portable Karaoke system by the hand to sing a song.

Furthermore, many countries including Korea increasingly put restrictions on frequencies of radio transmission devices. Thus, the portable Karaoke system cannot avoid the restrictions on the frequencies when a radio transmission circuit is constructed on the board provided in the system.

FIG. 1 is a cross-sectional view of the conventional portable Karaoke system including a modularized transmitting/receiving device. The portable Karaoke system includes a microphone 3 provided at one end of a case 1, a key unit 2 through which a user selects a song, and a display 4. The portable Karaoke system further includes an open part 10 located on one side of the case 1, an accommodating part 11 extended from the end of the case 1, a first connector 13, a transmitting/receiving module 15, and a cover 16. One end of the accommodating part 11 is opened and connected with the inside of the case 1. The first connector 13 is placed on a board 12 set inside the case 1 and protruded to the inside of the accommodating part 11. The transmitting/receiving module 15 is formed such that it can be inserted into the accommodating part 11 and includes a transmitting/receiving circuit for transmitting/receiving video and audio signals. The transmitting/receiving module 15 has a second connector 14 formed at one end thereof. The second connector 14 is connected to the first connector 13 to connect the transmitting/receiving circuit to the control circuit of the portable Karaoke system. The cover 16 covers the open part 10 of the case 1.

The transmitting/receiving module 15 further includes an FM transmitter circuit (not shown), a receiving antenna, and a radio auxiliary microphone receiver circuit (not shown). The FM transmitter circuit has a transmission antenna that modulates an audio signal output from the portable Karaoke system into a predetermined FM frequency and then transmits the modulated signal to an external FM radio. The receiving antenna receives a radio signal transmitted from a radio auxiliary microphone separated from the portable Karaoke system. The wireless auxiliary microphone receiver circuit demodulates the radio signal received by the receiving antenna and divides the demodulated signal into an audio signal and a song data signal.

A user can easily connect/disconnect the transmitting/receiving module 15 to/from the portable Karaoke system to use the system. However, since the transmitting/receiving module 15 includes both of the FM transmitter circuit and the radio auxiliary microphone receiver circuit, the user cannot select and use one of FM transmission and radio auxiliary microphone receiving functions. Furthermore, the user should purchase an unnecessary functional module. Moreover, the volume of the transmitting/receiving module 15 becomes large because it includes even the transmission antenna and the receiving antenna. Accordingly, the user has a difficulty in carrying the portable Karaoke system including the transmitting/receiving module 15.

FIG. 2 is a perspective view of a conventional portable Karaoke system having a battery housing structure. Referring to FIG. 2, the portable Karaoke system includes a case 20 a user can easily hold and a signal connecting device (not shown) for connecting the case 20 to external apparatuses (for example, an audio system, TV set and so on).

A microphone net 21 is set on the top of the case 20 and a printed circuit board 22 including various electronic components for operating the portable Karaoke system is set inside the case 20. A key input unit 23 having a plurality of key buttons (not shown) electrically connected to the printed circuit board 22 is provided on one side of the case 20. In addition, a battery case 24 for housing at least one battery for supplying power to the portable Karaoke system is arranged on the other side of the case.

The battery case 24 has a rectangular groove in which batteries are serially connected in the direction of the length thereof. Contact terminals 25 and 25' are respectively set at both ends of the battery case to be electrically connected to the printed circuit board 22. The contact terminals 25 and 25' are respectively made of a metal plate and a spring.

The portable Karaoke system further, includes a cover 26 for covering the case 20. The case 20 and the cover 26 are tightly combined such that a part of the case is fitted in the cover 26. An input/output terminal 27 to which a main jack of the signal connecting device is connected is formed at the bottom of the case 20.

To use the portable Karaoke system, the user inserts a predetermined battery into the battery case 24, arranging the positive and negative polarities of the battery, and combines the cover 26 with one side of the case 20. Here, a space exists between the battery in the battery case 24 and the cover 26 so that the battery is easily separated from the battery case when an external shock is applied to the case. Thus, the portable Karaoke system is not operated.

To replace the battery with a new one, the cover 26 is separated from the case 20 and the battery fitted in the battery case 24 is removed from the battery case. At this time, the battery should be separated from the battery case by putting a thin long hard substance, such as a fingernail, between the end of the battery case and the end of the battery and removing the battery. However, the user has a difficulty in removing the battery from the battery case when he/she has a short fingernail. Furthermore, the user cannot replace the battery with a new one rapidly if he/she is difficult to find a thin long hard substance.

Moreover, the conventional portable Karaoke system has a single gear formed at the end of the case, which is combined with a microphone cartridge, such that only one of a general microphone net or a ball-type microphone net can be combined with the case through the gear. Thus, the user cannot selectively use the general microphone net and the ball-type microphone net.

DISCLOSURE OF INVENTION

Accordingly, an object of the present invention is to provide a portable Karaoke system having a separate radio auxiliary microphone receiving module and a separate FM transmission module, which can be inserted/separated into/from the portable Karaoke system, such that a user can select and purchase only a required function module and easily carry and keep the portable Karaoke system.

Another object of the present invention is to provide a portable Karaoke system having hooks, which are provided at both sidewalls of a battery case to prevent a battery from being easily separated from the battery case, and semicircular recesses, which are formed at the top edges of both sidewalls of the battery case to allow a user to easily remove the battery from the battery case.

Yet another object of the present invention is to provide a portable Karaoke system having first and second gears formed at stepped portions of the end of a microphone body such that the first gear is combined with a general microphone net and the second gear is combined with a ball-type microphone net.

To accomplish the object, according to the present invention, there is provided a portable Karaoke system including: a case forming the external shape of the portable Karaoke system; a printed circuit board that is set in the case and includes a control circuit for operating the Karaoke system: an FM transmission board including a transmission circuit for modulating an audio signal output from the portable Karaoke system into a predetermined FM frequency and radio-transmitting the modulated signal to an external radio; an FM transmission module having a first connector electrically connected to an output signal line of the FM transmission board, the FM transmission module being constructed in a separate single pack; a second connector that is arranged in a predetermined position of the case and connected to the first connector of the FM transmission module to transmit an output signal of the FM transmission module to the control circuit of the printed circuit board; and an antenna wire having a predetermined length, which is arranged in a predetermined position of the case and electrically connected to a transmission antenna terminal of the second connector.

Preferably, the case includes an accommodation part for accommodating the radio auxiliary microphone receiving module and the FM transmission module.

The accommodation part includes a pair of first guide grooves that are respectively formed in both sidewalls of the accommodation part and guide the radio auxiliary microphone receiving module to its right position, and a pair of second guide grooves that are respectively formed in both sidewalls of the accommodation part and guide the FM transmission module to its right position A first housing forming the body of the radio auxiliary microphone receiving module has a pair of first guide protrusions that are formed on both sides of the first housing and slidably inserted into the first guide grooves in the vertical direction, and a second housing forming the body of the FM transmission module has a pair of second guide protrusions that are formed on both sides of the first housing and slidably inserted into the second guide grooves in the vertical direction.

The case includes a battery case into which at least one battery is inserted.

The battery case has a pair of hooks having elasticity, which are respectively fixed to both sidewalls of the battery case to prevent the battery from being easily removed from the battery case.

The battery case further includes recesses formed at the top edges of both sidewalls of the battery case to allow a user to easily remove the battery from the battery case by the finger.

The end of a microphone body of the portable Karaoke system of the present invention, which is combined with a microphone cartridge, has a stepped form. A first gear is formed at a thicker stepped portion and a second gear is formed at a thinner stepped portion.

The first gear is combined with a combining ring and a microphone net, and the second gear is combined with a fixing ring and a ball-type microphone net.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Figure 1:
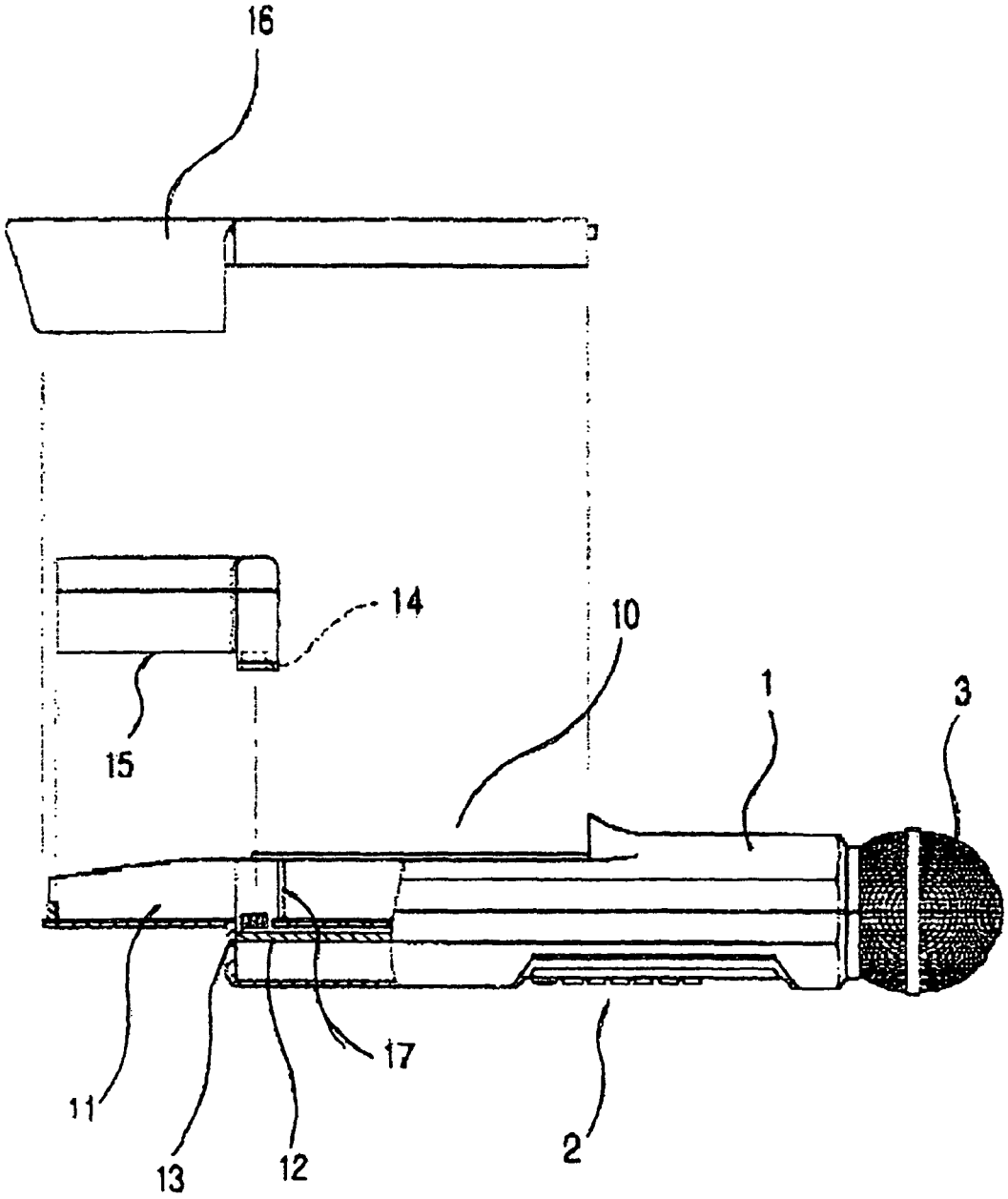
FIG. 1 is a cross-sectional view of a conventional portable Karaoke system including a modularized transmitting/receiving device.
Figure 2:
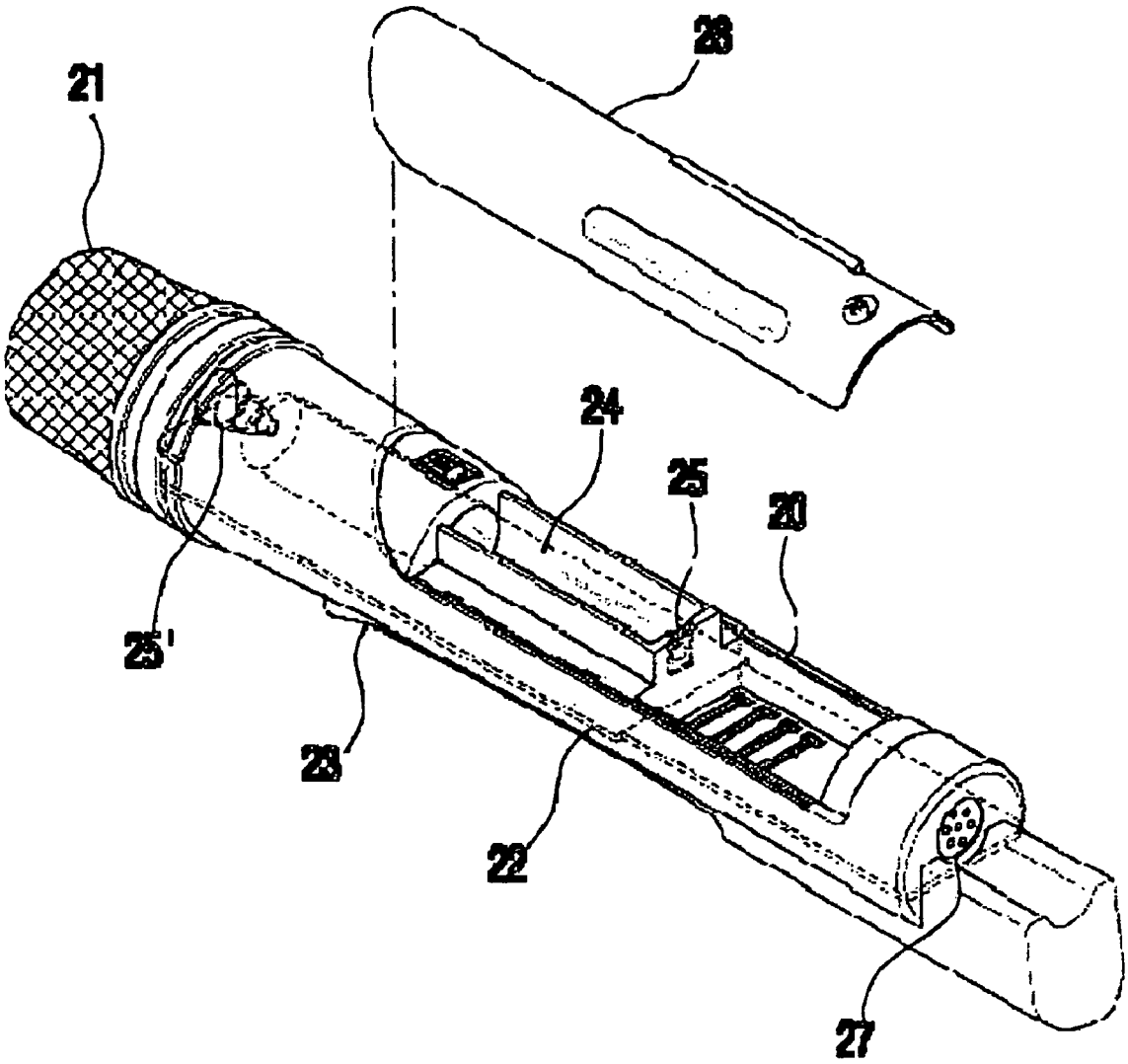
FIG. 2 is a perspective view of a conventional portable Karaoke system having a battery housing structure.

The present invention will now be described in detail in connection with preferred embodiments with reference to the accompanying drawings. For reference, like reference characters designate corresponding parts throughout several views.

Figure 3:
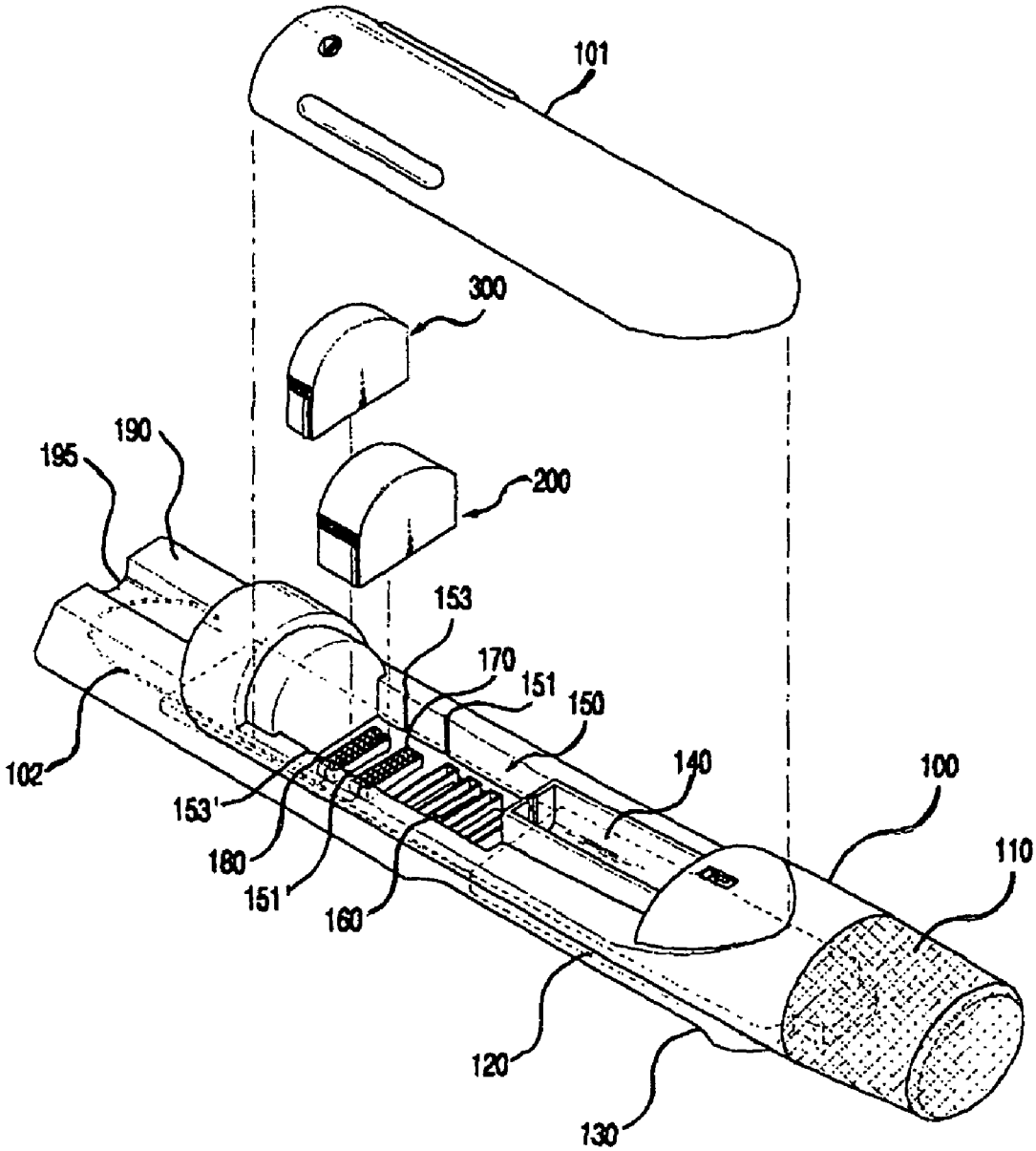
FIG. 3 is a perspective view of a portable Karaoke system having separable communication modules according to an embodiment of the present invention.
Figure 4:
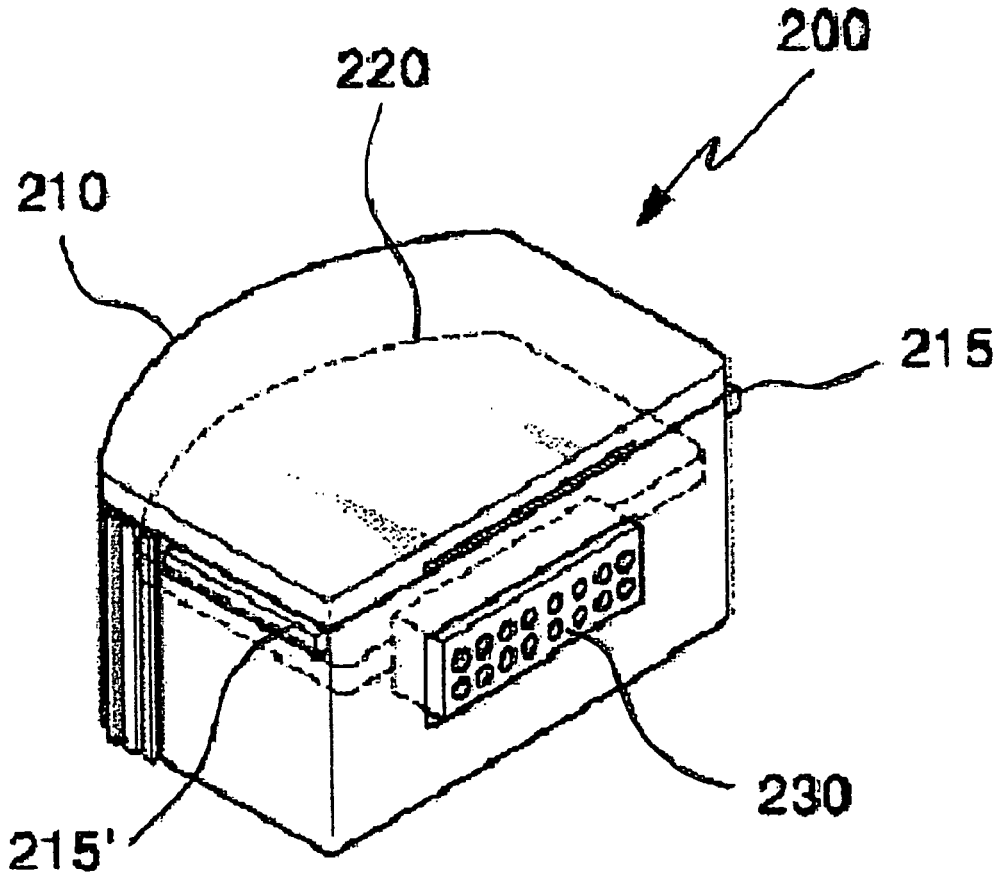
FIG. 4 is a perspective view of a radio auxiliary microphone receiving module applied to the portable Karaoke system of the present invention.
Figure 5:
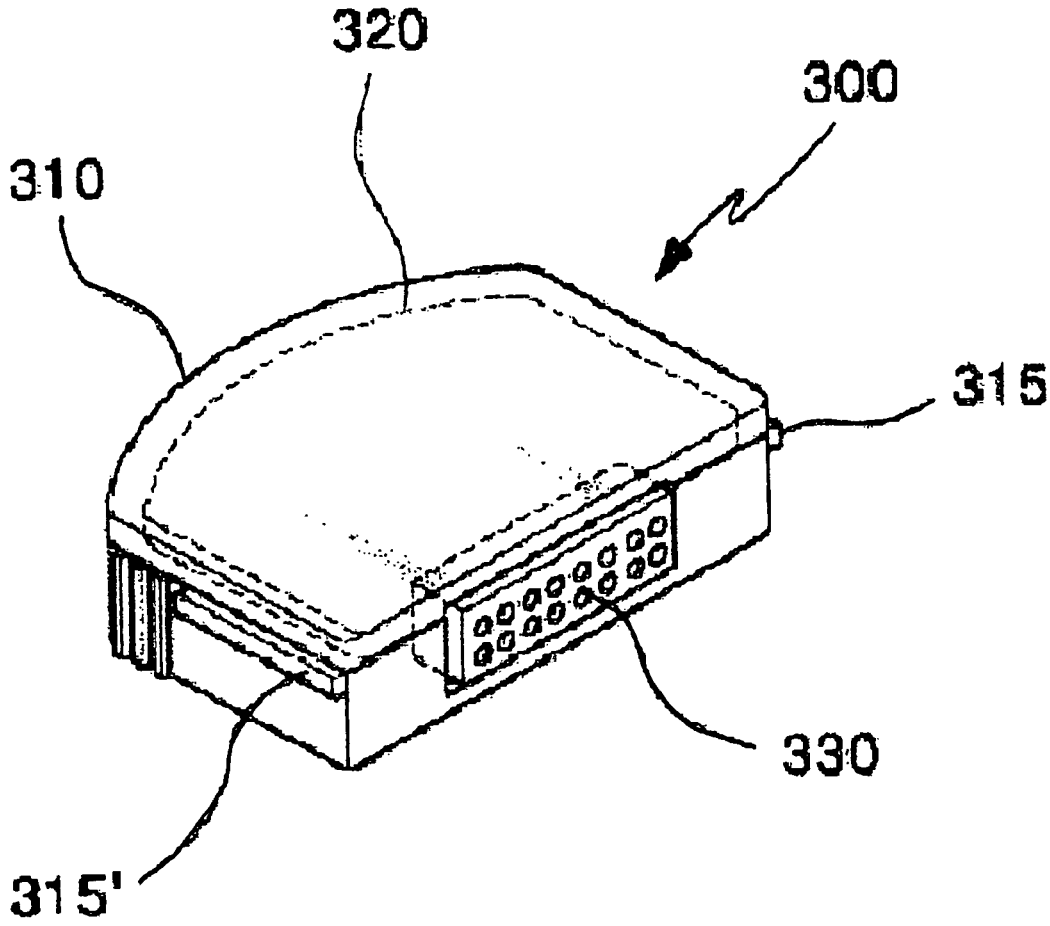
FIG. 5 is a perspective view of an FM transmission module applied to the portable Karaoke system of the present invention.

FIG. 3 is a perspective view of a portable Karaoke system having separable communication modules according to an embodiment of the present invention, and FIG. 4 is a perspective view of a radio auxiliary microphone receiving module applied to the portable Karaoke system of the present invention. FIG. 5 is a perspective view of an FM transmission module applied to the portable Karaoke system of the present invention.

Referring to FIG. 3, the portable Karaoke system according to an embodiment of the present invention includes a case 100 forming the external shape of the portable Karaoke system, a radio auxiliary microphone receiving module 200 that is fitted into the case 100 in a separable manner and receives a radio signal transmitted from a separate radio auxiliary microphone (not shown), an FM transmission module 300 that is fitted into the case 100 in a separable manner and radio-transmits an audio signal output from the portable Karaoke system with a predetermined FM frequency, and a cover 101 that is tightly combined with the case to cover a part of the case 100.

The case 100 has a long shape such that a user can easily hold it to sing a song. A microphone net 110 is set on the top of the case 100, and a printed circuit board 120 including a control circuit for operating the portable Karaoke system is fitted into the case 100.

Furthermore, a key input unit 130 having a plurality of key buttons electrically connected to the printed circuit board 120 is located on one side of the middle part of the case 100, and a battery case 140 for housing a battery supplying power to the portable Karaoke system is arranged on the other side of the case 100.

An accommodation part 150 for accommodating a plurality of memory packs (not shown), the radio auxiliary microphone receiving module 200 and the FM transmission module 300 is formed under the battery case 140. The accommodating part 150 includes a plurality of memory connectors, a male connector 170 for the radio auxiliary microphone receiving module 200 and a male connector 180 for the FM transmission module 300, which are fixed to the bottom of the accommodating part 150. The memory connectors and the male connectors 170 and 180 are protruded from the bottom of the accommodation part 150 such that the memory packs and the receiving module 200 and the transmission module 300 can be easily connected with the memory connectors and the male connectors (170,180) and electrically connected to the printed circuit board 120. The accommodation part 150 has a pair of first guide grooves 151 and 151' respectively formed in both sidewalls of the accommodation part 150 and a pair of second guide grooves 153 and 153' respectively formed in both sidewalls of the accommodation part 150. The first guide grooves 151 and 151' guide the radio auxiliary microphone receiving module 200 to its right position and the second guide grooves 153 and 153' guide the FM transmission module 300 to its right position.

An input/output terminal (not shown) to which a main jack of a separate signal connecting device is connected is provided at the bottom of the case 100. In addition, a protruded support 190 having a groove 195 is extended from the bottom end of the case 100 such that the protruded support 190 stably supports the main jack of the signal connecting device. Here, the signal connecting device is connected to the input/output terminal to provide video and audio signals transmitted from the portable Karaoke system to an external audio system or display (for example, a TV set or a CRT).

Referring to FIG. 4, the radio auxiliary microphone receiving module 200 includes a first housing 210 constructing the body of the receiving module 200, a radio receiving board 220 fitted into the first housing 210, and a female connector 230 connected to an output signal line of the radio receiving board 220. The radio receiving board 220 has a radio auxiliary microphone receiving circuit that demodulates a radio signal transmitted from the radio auxiliary microphone and captured by an antenna wire, which will be explained later, and divides the demodulated signal into an audio signal and a song data signal. The female connector 230 is attached to one side of the first housing 210 such that it can be connected with the male connector 170 for the radio auxiliary microphone receiving module 200, which is placed in the accommodation part 150 of the case 100. The female connector 230 electrically connects the radio auxiliary microphone receiving circuit to the control circuit of the main body of the portable Karaoke system. The radio auxiliary microphone receiving module 200 further includes a pair of guide protrusions 215 and 215' that are respectively formed on both sides of the first housing 210. The guide protrusions 215 and 215' are slidably inserted into the first guide grooves 151 and 151' of the case 100 (shown in FIG. 3).

Referring to FIG. 5, the FM transmission module 300 includes a second housing 310 constructing the body of the FM transmission module, an FM transmission board 320 fitted into the second housing 310, and a female connector 330 electrically connected to an output signal line of the FM transmission board 320. The FM transmission board 320 has a transmission circuit that modulates an audio signal output from the portable Karaoke system into a predetermined FM frequency and transmits the modulated signal to an external radio through the antenna wire 102.

The female connector 330 is set on one side of the second housing 310 such that it can be connected to the male connector 180 for the FM transmission module, which is placed in the case 100. The female connector 300 electrically connects the FM transmission circuit to the control circuit of the main body of the portable Karaoke system. The FM transmission module 300 further includes a pair of second guide protrusions 315 and 215' that are respectively formed on both sides of the second housing 310 and slidably inserted into the second guide grooves 153 and 153' of the main body of the portable Karaoke system, shown in FIG. 3.

Preferably, the FM transmission module 300 is smaller than the radio auxiliary microphone receiving module 200.

Referring back to FIG. 3, the cover 101 is tightly combined with the case 100 such that the cover 101 covers a part of the case 100, or the battery case 140 and the accommodation part 150.

The antenna wire 102 is electrically connected to transmission/receiving antenna terminals (not shown) of the male connector 170 for the radio auxiliary microphone receiving module and the male connector 180 for the FM transmission module. Though it is preferable that the antenna wire 102 is formed in a 'U' shape in the protruded support 109 such that it can easily transmit and capture transmitted/received electric waves, the antenna wire 102 can be formed in a predetermined length at a predetermined place inside the case 100.

The operation of the separate communication modules of the portable Karaoke system according to the present invention will now be explained.

When a plurality of users want to sing a song together using the portable Karaoke system of the present invention, the radio auxiliary microphone is used. The portable Karaoke system receives a radio signal transmitted from the radio auxiliary microphone via the radio auxiliary microphone receiving module 200 included therein.

Specifically, the cover 101 is separated from the case 100, and then the radio auxiliary microphone receiving module 206 is vertically inserted into the accommodation part 150 such that the female connector 230 of the radio auxiliary microphone receiving module 200 is connected with the male connector 170 protruded from the bottom of the accommodation part 150.

More specifically, the pair of guide protrusions 215 and 215' formed on both sides of the first housing 210 of the radio auxiliary microphone receiving module 200 is slidably inserted into the first guide grooves 151 and 151' of the accommodation part 150. When the female connector 230 of the radio auxiliary microphone receiving module 200 meets the male connector 170 of the accommodation part 150, a user pushes the first housing 210 of the radio auxiliary microphone receiving module 200 with a predetermined pressure such that the female connector 230 is combined with the male connector 170.

When the radio auxiliary microphone is not used, the user separates the cover 101 from the case 100 and holds the housing 210 of the radio auxiliary microphone receiving module 200, combined with the male connector 170 of the accommodation part 150, by the fingers and lifts up the housing 210. Then, the female connector 230 combined with the male connector 170 is separated from the male connector 170 and thus the radio auxiliary microphone receiving module 200 is completely removed from the accommodation part 150. The user can easily carry or keep the radio auxiliary microphone receiving module 200 because it is small.

In the case that the user wants to radio-transmit an audio signal output from the portable Karaoke system according to the present invention with a predetermined FM frequency, he/she sets the FM transmission module 300 in the portable Karaoke system. The operation of inserting/separating the FM transmission module 300 into/from the accommodation part 150 of the case 100 is identical to the operation of inserting/separating the radio auxiliary microphone receiving module 200 into/from the accommodation part 150 so that an explanation thereon is omitted.

Figure 6:
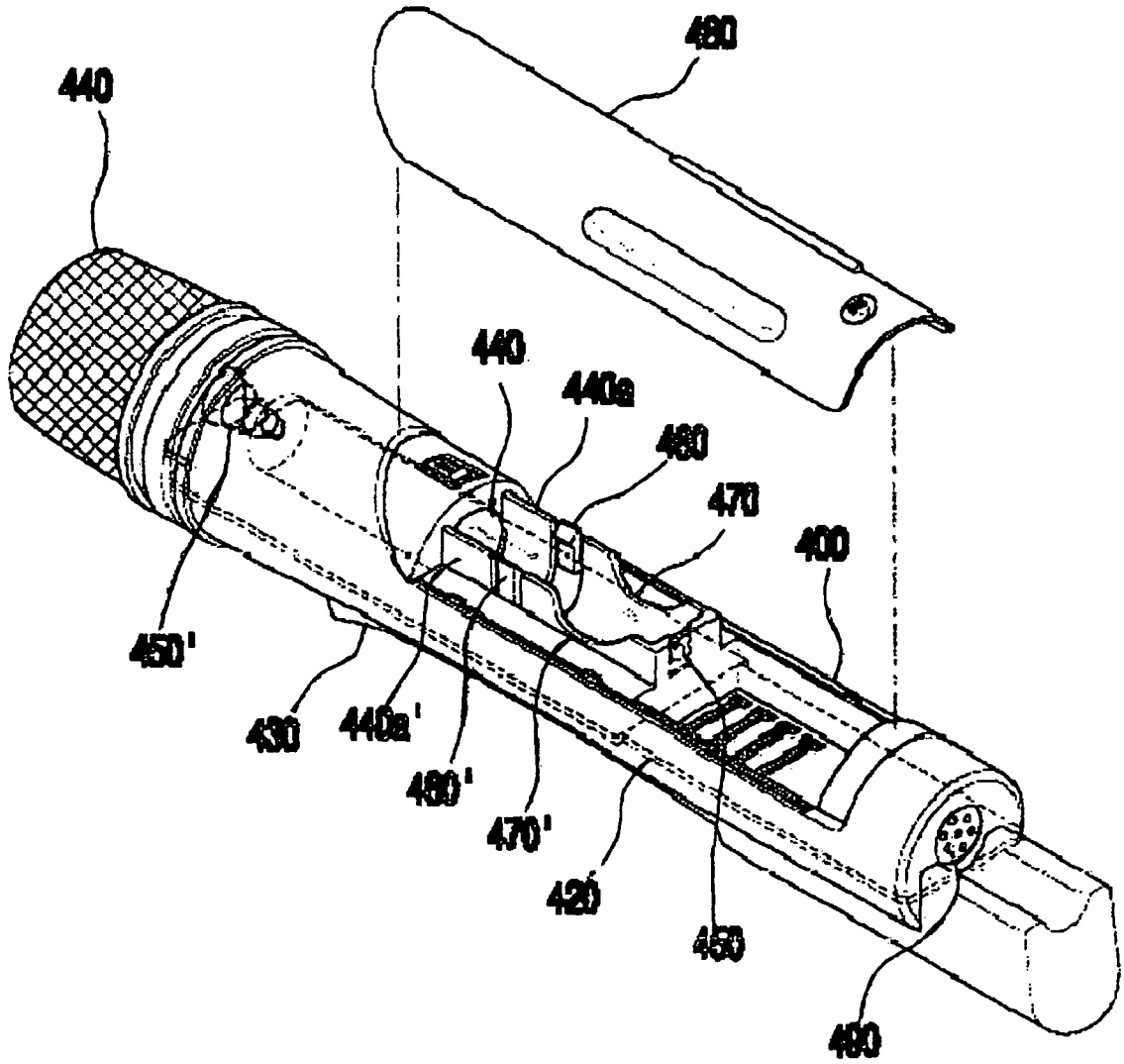
FIG. 6 is a perspective view of a portable Karaoke system having a battery housing structure according to another embodiment of the present invention.

FIG. 6 is a perspective view of a portable Karaoke system having a battery housing structure according to another embodiment of the present invention.

Referring to FIG. 6, the portable Karaoke system includes a case 400 easily held by a user and a signal connecting device (not shown) for electrically connecting the case 400 to external devices (not shown).

A microphone net 410 is placed on the top of the case 400, and a printed circuit board 420 including various electronic components for operating the portable Karaoke system is fitted into the case 400. A key input unit 430 having a plurality of key buttons (not shown), electrically connected to the printed circuit board 420, is provided on one side of the middle part of the case 400. A battery case 440 for housing at least one battery for providing operation power to the portable Karaoke system is located on the other side of the middle part of the case 400.

The battery case 440 is formed in a rectangular groove such that batteries are serially connected in the direction of length thereof. Contact terminals 450 and 450' are respectively provided at both ends of the battery case 440 and electrically connected to the printed circuit board 420. The contact terminals 450 and 450' are respectively made of a metal plate and a spring. Preferably, the bottom face of the battery case 440 has a semicircular form in order to surround the outer face of the battery 500.

Furthermore, the battery case 440 has a pair of hooks 460 and 460' that are respectively fixed to both sidewalls 440*a* and 440*a'* of the battery case 440, opposite to each other. The hooks 460 and 460' each have elasticity to prevent the battery 500 from being easily separated from the battery case 400 due to an external shock. In addition, semicircular recesses 470 and 470' are respectively formed at the top edges of both sidewalls 440*a* and 440*a'* of the battery case 440 to allow the user to easily remove the battery 500 from the battery case 440 by the fingers.

Reference numerals 480 and 490 respectively denote a cover and an input/output terminal. The cover 480 is tightly combined with the case 400 such that the cover covers a part of the case to protect it. The input/output terminal 490 is provided at the bottom of the case 400 and electrically connected to a main jack of the signal connecting device.

Figure 7A:
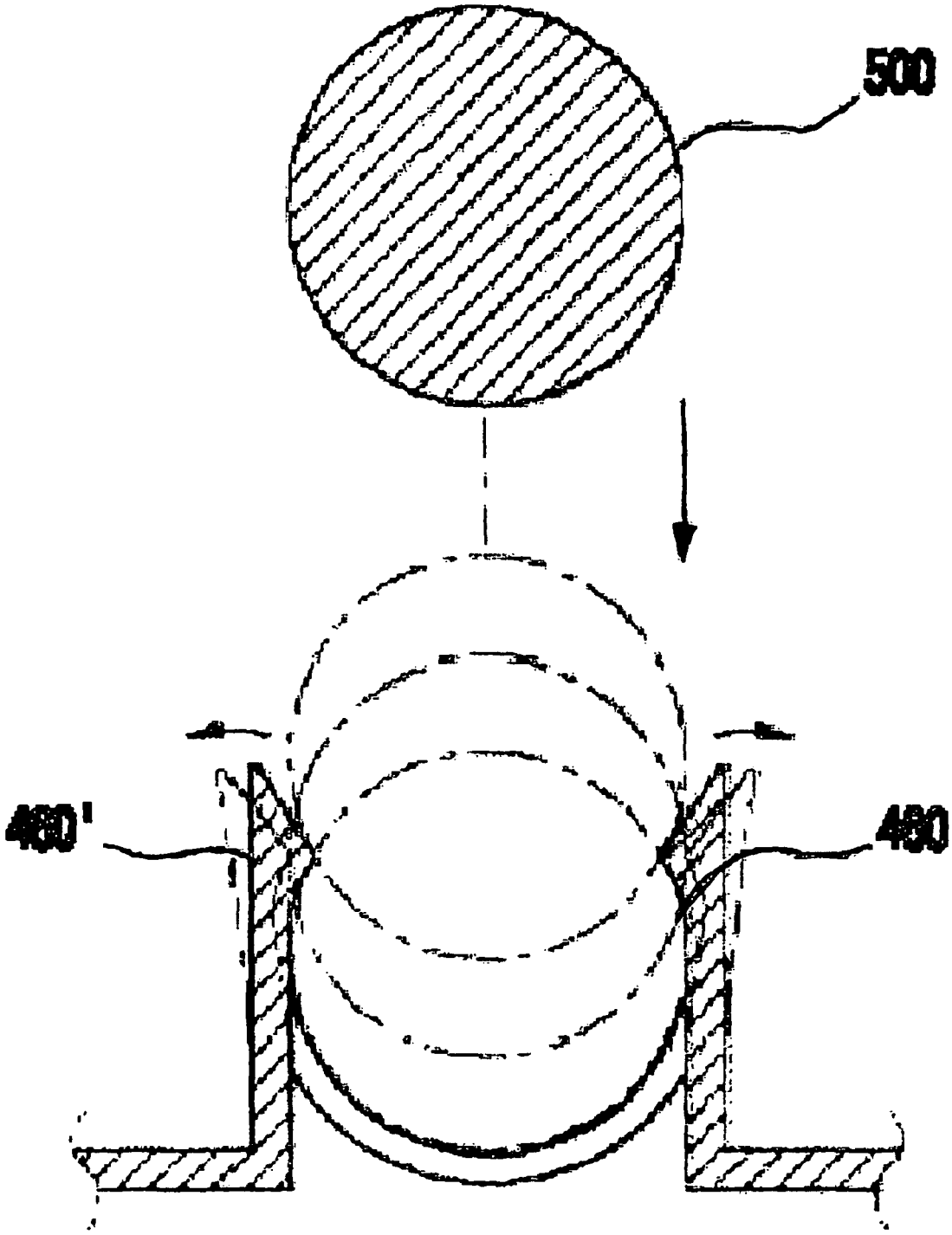
FIG. 7*a* illustrates an operation of inserting a battery into a battery case having hooks, included in the portable Karaoke system according to an embodiment of the present invention.

The operation of the battery housing structure of the portable Karaoke system according to the present invention will now be explained with reference to FIGS. 7*a* and 7*b*. FIG. 7*a* illustrates an operation of inserting a battery into the battery case having hooks, included in the portable Karaoke system according to an embodiment of the present invention, and FIG. 7*b* illustrates an operation of removing the battery from the battery case.

To fit the battery 500 into the battery case of the portable Karaoke system according to the present invention, the cover 480 is separated from the case 400 and then the battery 500 is fitted into the battery case 440. When the outer face of the battery 500 reaches the hooks 460 and 460' of the battery case 440, the outer face of the battery 500 is mounted on the upper parts of the hooks 460 and 460', which are bent toward the inside of the battery case at a predetermined angle. In this state, when the user pushes the battery 500, the hooks 460 and 460' are elastically wide open within a predetermined angle so that the outer face of the battery 500 slides on both sidewalls 440*a* and 440*a'* of the battery case 440 to be fitted into the battery case 440. Simultaneously, the hooks 460 and 460' are returned to their original positions according to elasticity to apply a predetermined pressure to the outer face of the battery 500. Thus, the battery 500 is not easily separated from the battery case even when an external shock is applied thereto.

Figure 7B:
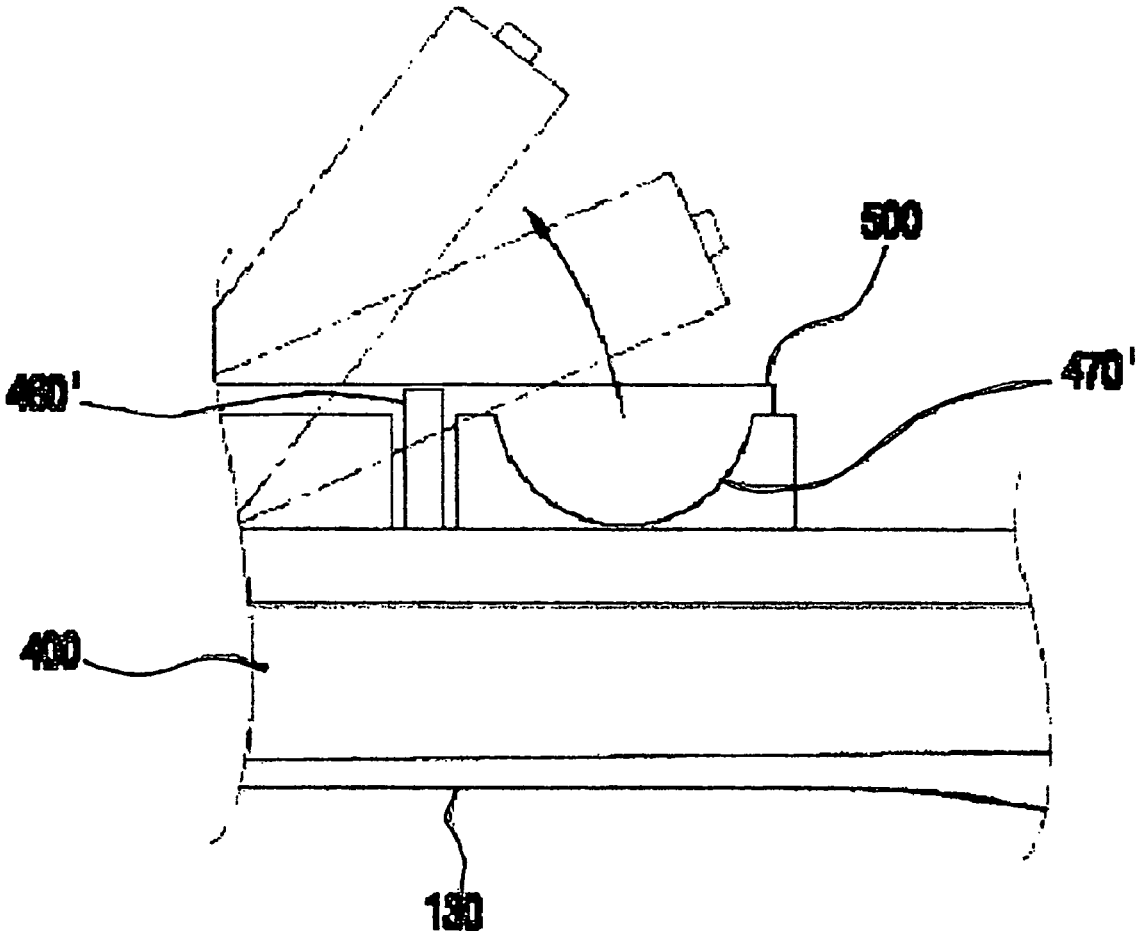
FIG. 7*b* illustrates an operation of removing the battery from the battery case.

When the battery 500 is replaced with a new one, as shown in FIG. 7*b*, the user separates the cover 480 from the case 400 and then holds the recesses 470*a* and 470*a'* formed at the top edges of both sidewalls 440*a* and 440*a'* of the battery case 440. In this state, when the user lifts up the end of the battery 500, the outer face of the battery 500 slides on both sidewalls 440*a* and 440*a'* to be lifted upward. Here, the hooks 460 and 460' are elastically wide open within a predetermined angle and thus the battery 500 is completely separated from the battery case 440. Simultaneously, the hooks 460 and 460' are returned to their original positions according to elasticity.

Figure 8:
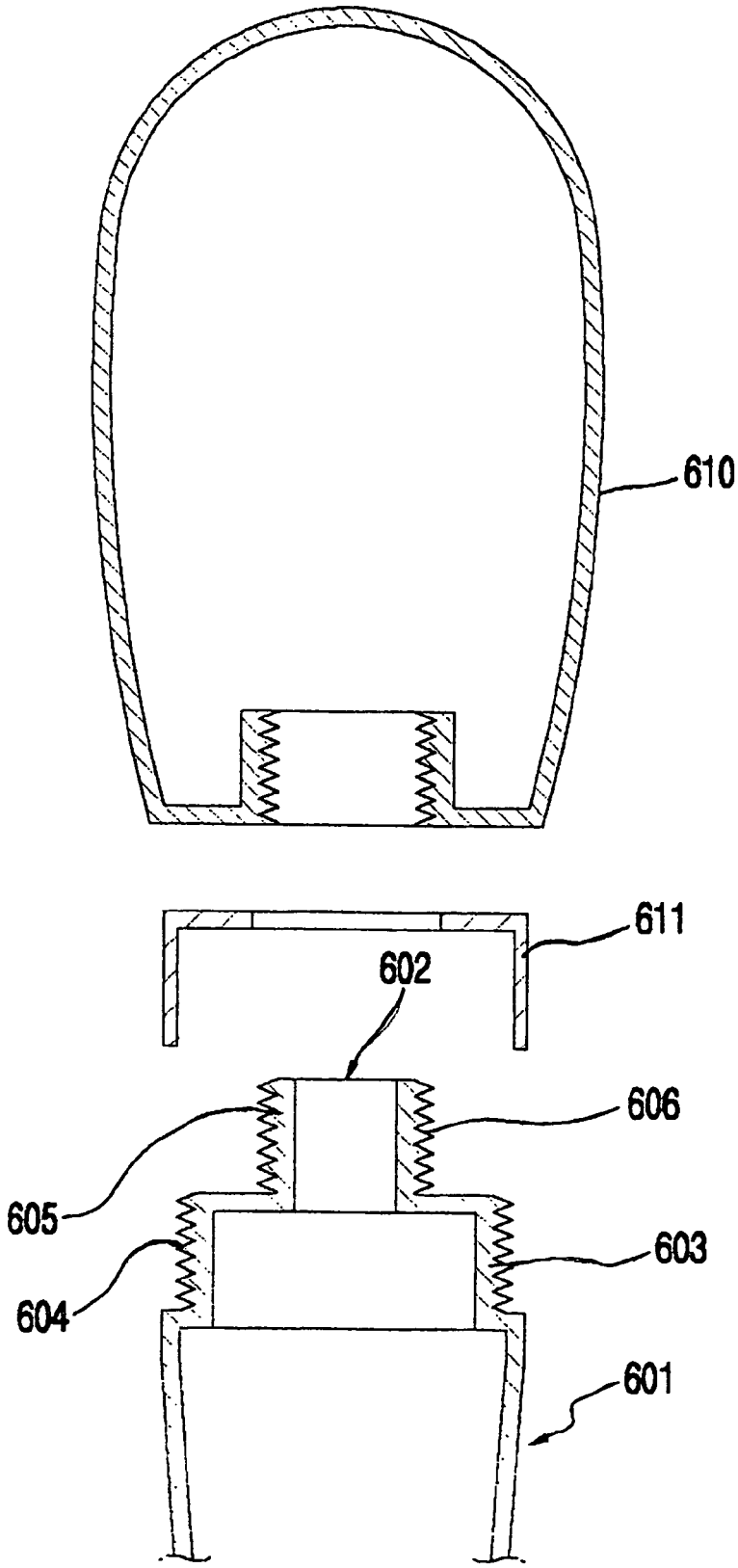
FIG. 8 illustrates combination of a microphone net and the portable Karaoke system according to an embodiment of the present invention.
Figure 9:
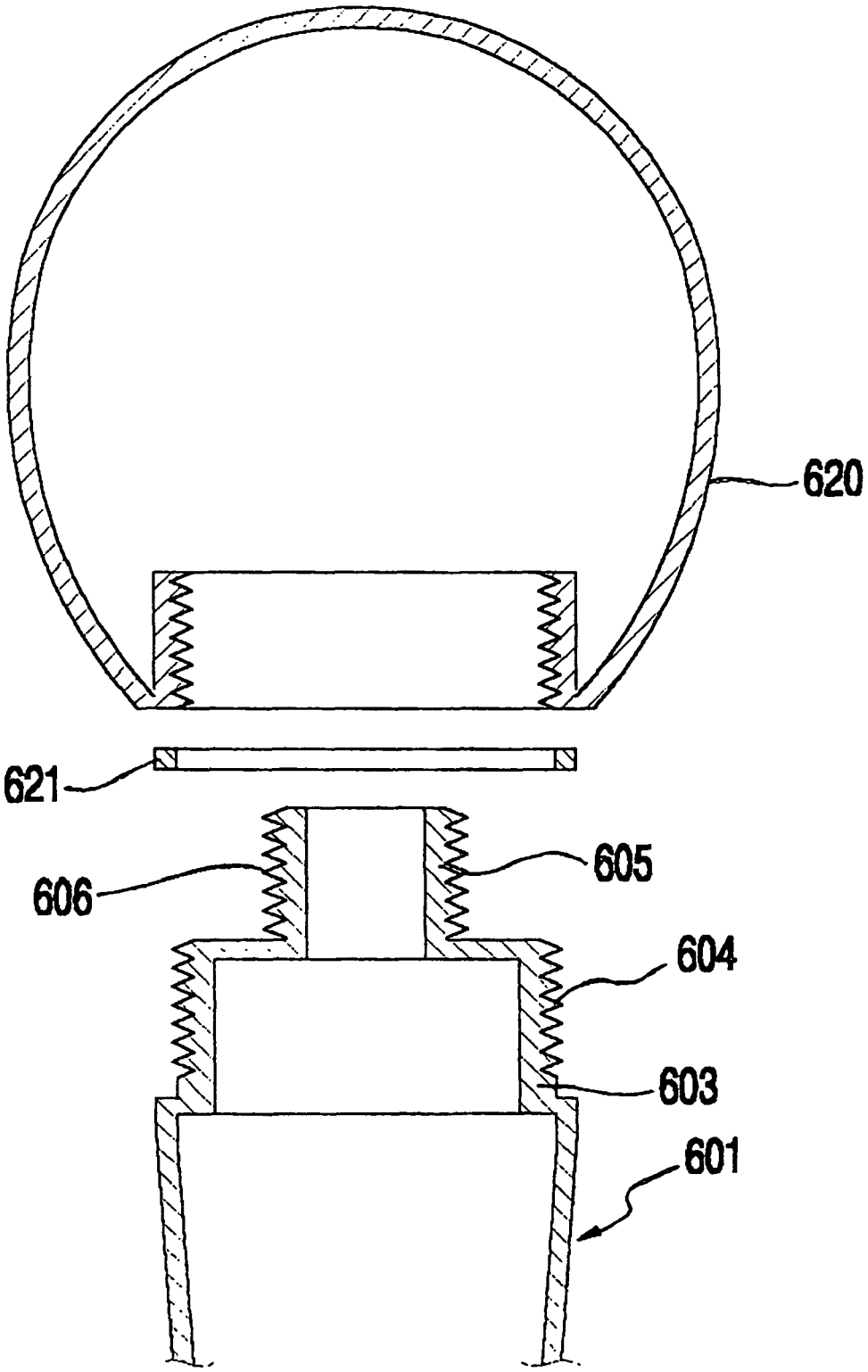
FIG. 9 illustrates combination of a ball-type microphone net and the portable Karaoke system according to another embodiment of the present invention.

FIG. 8 illustrates combination of a general microphone net and the portable Karaoke system according to the present invention, and FIG. 9 illustrates combination of a ball-type microphone net and the portable Karaoke system according to another embodiment of the present invention.

A microphone according to the present invention has a microphone main body 601. The end 602 of the microphone main body 601, which is combined with a microphone cartridge, has a stepped shape. A first gear 604 is formed at a thicker stepped portion 603 and a second gear 606 is formed at a thinner stepped portion 605.

When the user wants to use a general microphone net 610 shown in FIG. 8, the user combines a combining ring 611 with the first gear 604 and then combines the microphone net 610 with the first gear 604 using a screw. When the user wants to use a ball-type microphone net 620 shown in FIG. 9, the user combines a fixing ring 621 with the second gear 606 including the outside of the first gear 604 and combines the ball-type microphone net 620 with the second gear 606 using a screw.

INDUSTRIAL APPLICABILITY

According to the present invention, a user can separately insert/separate the radio auxiliary microphone receiving module and the FM transmission module into/from the portable Karaoke system. Thus, the user can select and purchase only a required function module. Furthermore, because the function modules are small-sized, the user can easily carry and keep them.

Furthermore, the battery can be prevented from being easily separated from the battery case using a pair of hooks provided at both sidewalls of the battery case when the portable Karaoke system is used. In addition, the user can easily separate the battery from the battery case by the fingers using the recesses formed at the top edges of both sidewalls of the battery case when he/she wants to replace the battery with a new one.

Moreover, both of a general microphone net and a ball-type microphone net can be combined with the portable Karaoke system because the end of the microphone main body has a stepped shape and the first and second gears having different diameters are formed at stepped portions.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A portable Karaoke system comprising:

a case forming the external shape of the portable Karaoke system;

a printed circuit board that is set in the case and includes a control circuit for operating the Karaoke system;

an FM transmission board including a transmission circuit for modulating an audio signal output from the portable Karaoke system into a predetermined FM frequency and radio-transmitting the modulated signal to an external radio;

an FM transmission module having a first connector electrically connected to an output signal line of the FM transmission board, the FM transmission module being constructed in a detachable separate single pack;

a second connector that is arranged in a predetermined position of the case and connected to the first connector of the FM transmission module to transmit an output signal of the FM transmission module to the control circuit of the printed circuit board; and an antenna wire having a predetermined length, which is arranged in a predetermined position of the case and electrically connected to a transmission antenna terminal of the second connector, wherein the antenna wire is not included in the detachable separate single pack that includes the FM transmission module, and wherein a protruded support having a groove in which a main jack of a separate signal connecting device is stably supported is extended from the bottom end of the case, and the antenna wire is formed in a 'U' shape inside the protruded support.

2. A portable Karaoke system comprising:

a case forming the external shape of the portable Karaoke system;

a printed circuit board that is set in the case and includes a control circuit for operating the Karaoke system;

a radio receiving board including a radio auxiliary microphone receiving circuit for receiving and demodulating a radio signal transmitted from a separate radio auxiliary microphone and dividing the demodulated signal into an audio signal and song data signal;

a radio auxiliary microphone receiving module having a third connector electrically connected to an output signal line of the radio receiving board, the radio auxiliary microphone receiving module being constructed in a detachable separate single pack;

a fourth second connector that is arranged in a predetermined position of the case and connected to the third connector of the radio auxiliary microphone receiving module to transmit an output signal of the radio auxiliary microphone receiving module to the control circuit of the printed circuit board; and an antenna wire having a predetermined length, which is arranged in a predetermined position of the case and electrically connected to a receiving antenna terminal of the fourth connector, wherein the antenna wire is not included in the detachable separate single pack that includes that radio auxiliary microphone receiving module, and wherein a protruded support having a groove in which a main jack of a separate signal connecting device is stably supported is extended from the bottom end of the case, and the antenna wire is formed in a 'U' shape inside the protruded support.

3. The portable Karaoke system as claimed in claim 2, further comprising:

an FM transmission board including a transmission circuit for modulating an audio signal output from the portable Karaoke system into a predetermined FM frequency and radio-transmitting the modulated signal to an external radio;

an FM transmission module having a first connector electrically connected to an output signal line of the FM transmission board, the FM transmission module being constructed in a separate single pack; and a second connector that is arranged in a predetermined position of the case and connected to the first connector of the FM transmission module to transmit an output signal of the FM transmission module to the control circuit of the printed circuit board, wherein a transmission antenna terminal of the second connector is electrically connected to the antenna wire.

4. The portable Karaoke system as claimed in claim 3, wherein the case includes an accommodation part for accommodating the radio auxiliary microphone receiving module and the FM transmission module, the accommodation part has a pair of first guide grooves for guiding the radio auxiliary microphone receiving module to its right position and a pair of second guide grooves for guiding the FM transmission module to its right position, the first and second guide grooves being formed in both sidewalls of the accommodation part, a first housing for housing the radio auxiliary microphone receiving unit has a pair of first guide protrusions that are respectively formed on both sides of the first housing in the vertical direction and slidably inserted into the first guide grooves, and a second housing for housing the FM transmission module has a pair of second guide protrusions that are respectively formed on both sides of the second housing in the vertical direction and slidably inserted into the second guide grooves.

5. The portable Karaoke system as claimed in claim 1, wherein a protruded support having a groove in which a main jack of a separate signal connecting device is stably supported is extended from the bottom end of the case, and the antenna wire is formed in a 'U' shape inside the protruded support.

* * * * *